US009132313B2

(12) United States Patent
Jones et al.

(10) Patent No.: US 9,132,313 B2
(45) Date of Patent: Sep. 15, 2015

(54) BENCH HALO

(76) Inventors: Geoffrey Ryan Jones, Fullerton, CA (US); Casey Thomas Shine, Placentia, CA (US)

( * ) Notice: Subject to any disclaimer, the term of this patent is extended or adjusted under 35 U.S.C. 154(b) by 84 days.

(21) Appl. No.: 13/398,689

(22) Filed: Feb. 16, 2012

(65) Prior Publication Data

US 2014/0287888 A1 Sep. 25, 2014

(51) Int. Cl.

*A63B 21/072* (2006.01)
*A63B 21/075* (2006.01)
*A63B 21/078* (2006.01)

(52) U.S. Cl.

CPC ..... *A63B 21/078* (2013.01); *A63B 2021/0786* (2013.01)

(58) Field of Classification Search

CPC .. A63B 21/06; A63B 21/078; A63B 21/1415; A63B 2021/078; A63B 2021/0783; A63B 2021/0786

USPC ..... 482/92–94, 104

See application file for complete search history.

(56) References Cited

U.S. PATENT DOCUMENTS

| | | | | | |
|---|---|---|---|---|---|
| 4,650,186 | A | * | 3/1987 | McCreery et al. | 482/104 |
| 4,757,998 | A | * | 7/1988 | Landin | 482/104 |
| 5,007,633 | A | * | 4/1991 | Lemire | 482/142 |
| 5,217,421 | A | * | 6/1993 | Chrysler | 482/104 |
| 5,433,686 | A | * | 7/1995 | Marsh | 482/104 |

* cited by examiner

*Primary Examiner* — Oren Ginsberg
*Assistant Examiner* — Gary D Urbiel Goldner
(74) *Attorney, Agent, or Firm* — Scott R. Maynard; Sean D. Burdick

(57) ABSTRACT

A portable bench press safety device for preventing injury to a weight lifter's head, face or neck which can be easily attached and removed without the need for tools from weight lifting benches of various sizes and dimensions.

4 Claims, 2 Drawing Sheets

BENCH HALO

FIELD OF THE INVENTION

The present invention generally relates to weight lifting safety equipment and more particularly, to a simple portable safety device for protecting a weight lifter's head, face and neck while performing a bench press.

BACKGROUND INFORMATION

The bench press is an exercise of the upper body. For bodybuilding purposes, it is used to strengthen the pectorals, deltoids, and triceps. While the person lies on his or her back, the person performing the bench press lowers a weight to the level of the chest, then pushes it back up until the arm is straight and the elbows are locked. The exercise focuses on the development of the pectoralis major muscle as well as other supporting muscles including the anterior deltoids, serratus anterior, coracobrachialis, scapulae fixers, trapezii, and the triceps. The bench press is one of the three lifts in the sport of powerlifting and is used extensively in weight training, bodybuilding, and other types of fitness training to develop the chest.

In weight training, training to failure is to repeat an exercise movement (such as the bench press) to the point of momentary muscular failure. Contrary to widespread belief, this is not the point at which the individual thinks they cannot complete any more repetitions, but rather the first repetition that fails due to inadequate muscular strength. By training to failure, one fatigues enough of the muscle fibers to prevent lifting a particular weight.

While training to failure is generally considered a good method for increasing both muscle strength and mass, it also increases the risk of injury especially injury caused by the loss of control of the weight. When a person is using free weights this risk can increase, especially in the case of a bench press when the lifter is raising and lower the weight near his head and neck and usually must return the barbell and weights to a rack that is positioned directly above his head and neck.

Because of the risk associated with lifting to muscle failure, it is generally advisable to perform such exercises with the assistance of a second person often termed a "spotter." A spotter however is not always available and people often exercise alone. The dangers of bench pressing alone have been made ever more clear in recent years with such high profile injuries such as the one to University of Southern California running back Stafon Johnson who suffered a serious throat injury in 2009.

The prior art discloses various safety devices and or mechanical substitutes for spotters. Many such devices, however, are integral to the weight bench, require elaborate hydraulic or counterweight mechanisms or simply fail to provide the needed protection for the weight lifters head, face and neck areas.

For example U.S. Pat. No. 5,141,480 to Lennox et al., discloses a bench press exercise apparatus having horizontal safety bars designed to prevent injury, however, the safety bars are large and integral to the apparatus and only provide safety if the person exercising lowers the bench.

Similarly, U.S. Pat. No. 4,799,673 to Selle discloses a bench press safety apparatus including safety supports and weight unloading shelves, which are laterally adjustable to permit alignment with weight discs on a barbell supported on the safety supports. Like the Lennox, Selle is also large and integral to the weight lifting bench.

Several other patents, e.g. U.S. Pat. Nos. 4,249,726, 4,368,884, 4,441,425, 4,635,930 5,273,506, 6,746,379 and 6,685,601 disclose bench press safety apparatuses, however, each suffers from similar shortcomings as those disclosed in Lennox and Selle in that they either are large or cumbersome, integrated into and specially designed to fit particular weight lifting benches, require complicated hydraulic or pulley assistance, or do not provide adequate protection for the lifter's head, face and/or neck.

It is an object of the present invention to overcome these and other shortcomings of current bench press safety apparatuses and to provide a lightweight compact and easily portable safety device, which can be used on a wide range of different sized weight lifting benches.

BRIEF DESCRIPTION OF THE DRAWINGS

These and other features and advantages of the present invention will be better understood by reading the following detailed description, taken together with the drawings wherein.

DETAILED DESCRIPTION OF THE ILLUSTRATIVE EMBODIMENTS

The following descriptions and examples are included to illustrate preferred embodiments of the present invention. Those skilled in the art will appreciate that these descriptions and examples represent designs discovered by the inventor, which function well for the construction of the invention, and thus constitute examples as opposed to limitations on the invention. Those skilled in the art will also appreciate that, in light of the present disclosure, changes can be made in these illustrative or preferred embodiments that will not result in a departure from the spirit and scope of the invention.

FIGS. 1 through 4 illustrate one embodiment of the portable bench press safety device that is within the scope of the present invention. Unless otherwise specified the individual components of the bench press safety device are composed of steel. Nonetheless, any material capable of withstanding the forces imposed on the device by the weight of the barbell being dropped onto it from the average height of a weightlifters fully extended arms, may be used. Additionally, it may be necessary to use various combinations of materials, as discussed below, to obtain the desired strength.

Figure 1:
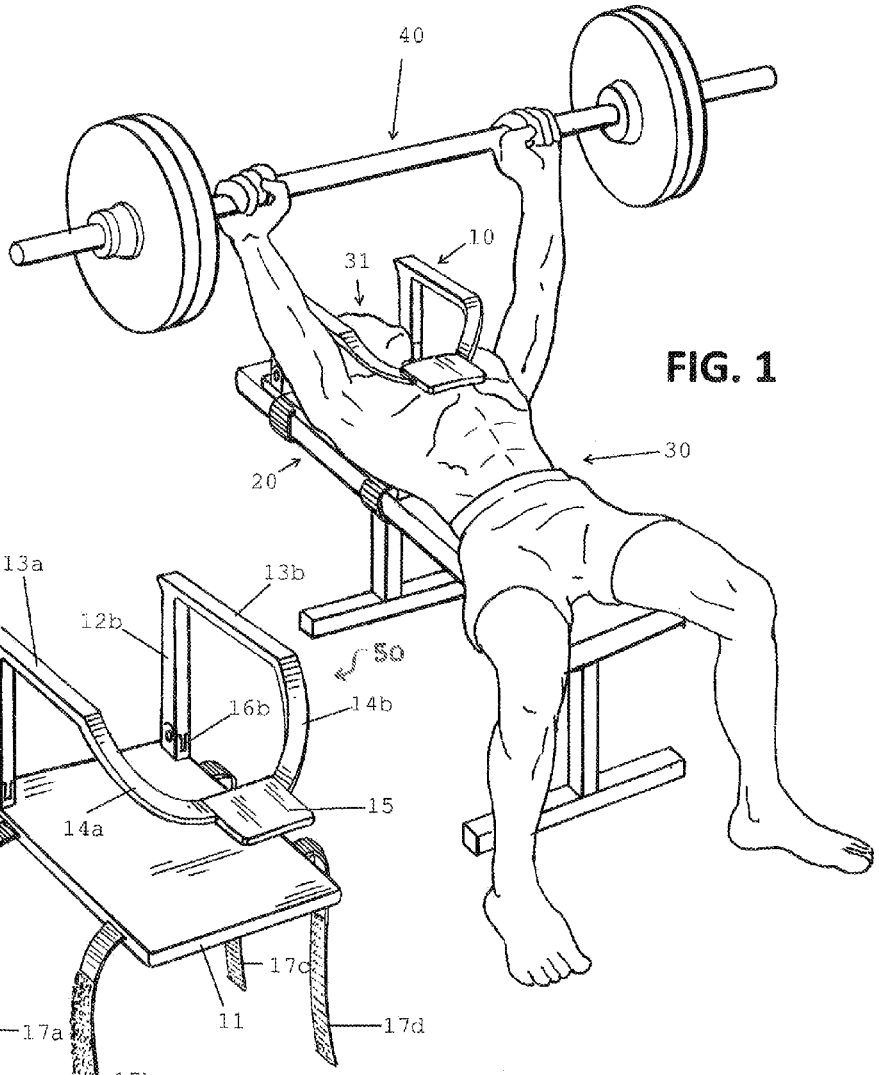
FIG. 1 shows a side perspective view of a person performing a bench press using the portable bench press safety apparatus.

FIG. 1 depicts the portable bench press safety device 10 temporarily secured to a standard bench 20. A person 30 is performing a bench press and has his arms fully extended placing the barbell 40 at its maximum height above his head 31. It is at this position, and when returning the barbell to the rack (not depicted), that the person exercising is at most risk of injury from dropping the barbell onto his head or neck should he become too fatigued.

Figure 2:
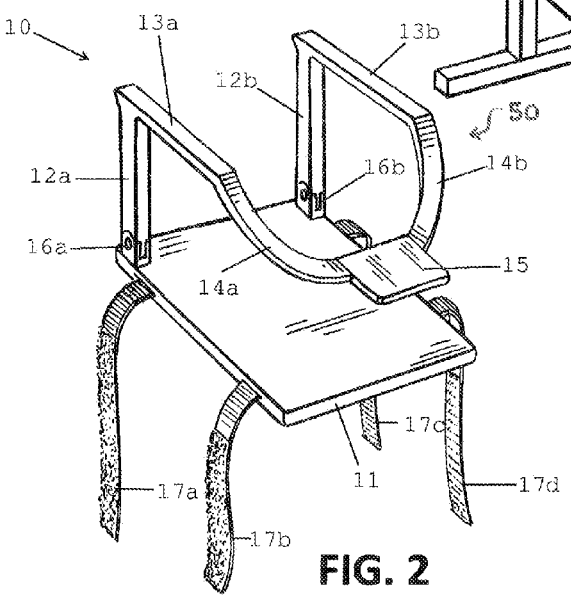
FIG. 2 shows a side perspective view of the portable bench press safety apparatus.

Turning to FIG. 2, the elements of the bench press safety device 10 can be more easily seen when it is removed from the bench 20. This embodiment of the bench press safety device consists generally of a base portion 11, first and second vertical support members 12*a* and 12*b* and a protective portion

50. Protective portion 50 comprises horizontal supports 13*a* and 13*b*, vertically descending portions 14*a* and 14*b*, and support plate 15. Vertically descending portions 14*a* and 14*b* descend downward from the ends of horizontal supports 13*a* and 13*b* toward base plate 11 and extend inward and attach to support plate 15. All of these supports, 12*a*, 12*b*, 13*a*, 13*b*, 14*a*, 14*b* and 15, can be attached at their respective joints as shown in FIG. 2 via wielding, if for example the are made of steel, or molded out of a single piece of material if they are made of some other type of material such as high tensile strength poly-carbonate.

As can be seen in FIG. 1, the support plate 15 rests on the person's 30 chest and sternum area and provides the mechanism to transfer and distribute the weight of the barbell 40 should it be dropped onto supports 13*a* and 13*b* between the persons chest on the one hand and the base plate 11 via supports 12*a* and 12*b* on the other. While the partial distribution of some weight onto the person's chest may cause some discomfort, it is far better than the alternative injury that could occur from the entire weight falling onto the person's head, face and/or neck. In an alternative embodiment, not shown, supports 14*a* and 14*b*, can be configured to extend downward and contact base 11. In this configuration, supports 14*a* and 14*b* would not extend inward as shown in FIG. 2, but instead only extend downward from their attachment points with supports 13*a* and 13*b*. Using this alternate configuration, none of the weight would be distributed to the person's chest instead being distributed to base 11.

One advantage of the safety device disclosed herein over the prior art bench press safety devices is its portability and compatibility with benches of varying dimensions. To this end, FIG. 2 depicts straps, which can be used to temporarily attach the device to benches, and which allows the device to be easily attached and removed without the use of any tools and/or easily transported to other gyms or other weight lifting facilities. These straps, 17*a*, 17*b*, 17*c* and 17*d*, can use such well known fastening means as hook-and-loop fasteners, double D-rings, or any other type of fastener that can be quickly and easily fastened or unfastened to allow for quick and easy attachment and removal of the device 10 from the bench 20.

Figure 3:
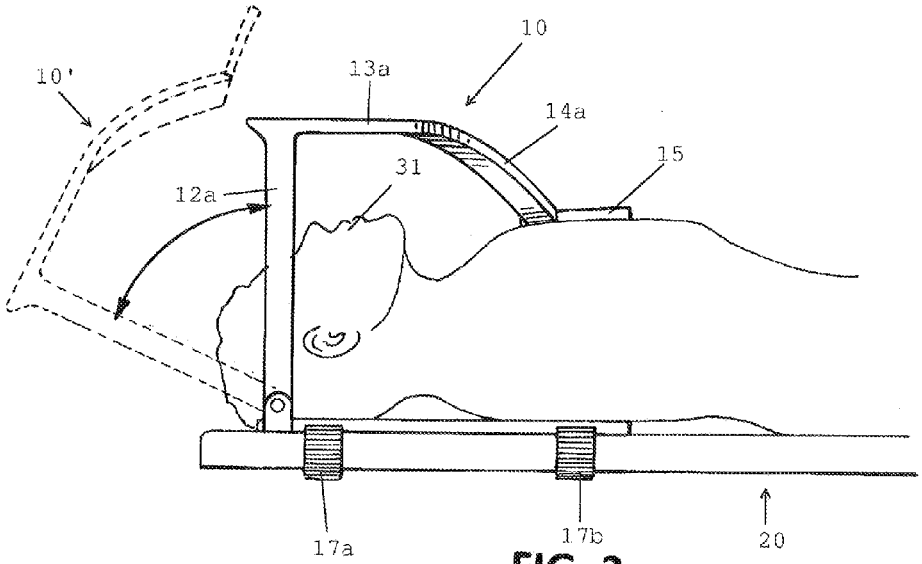
FIG. 3 shows a side view of the portable bench press safety apparatus.
Figure 4:
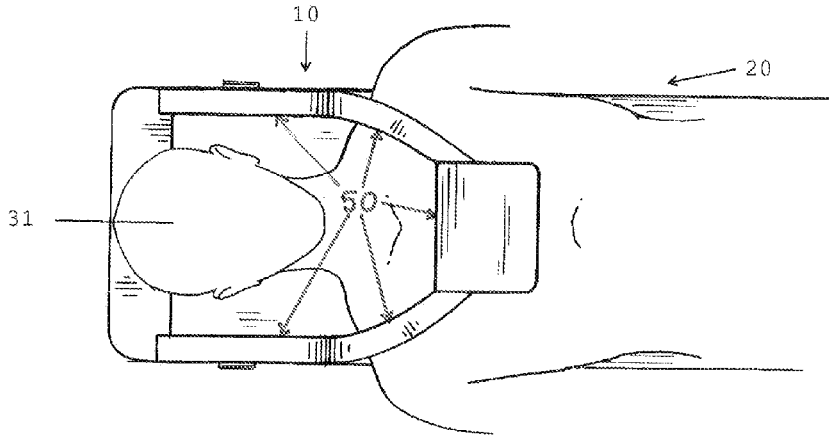
FIG. 4 shows a top view of the portable bench press safety apparatus.

To facilitate the raising and lowering of the device 10 over the persons head 31, hinges 16*a* and 16*b* are provided between supports 12*a* and 12*b* and the base 11. Turning to FIG. 3, the device 10 is depicted rotating open about the hinges 16*a* and 16*b* to its open position 10'. In its open position 10' it can be seen that the device is rotated up and away from the person's head 31 allowing for the person to easily extricate himself from the device.

In constructing the device 10, the inventors have found that one configuration that works well is to construct the supports 12*a*, 12*b*, 13*a*, 13*b*, 14*a*, 14*b* and 15 as well as the base 11 out of high tensile strength poly-carbonate and to construct the hinges 16*a* and 16*b* out of steel. This combination of materials provides for an overall decrease to the devices weight with the necessary strength added to the high stressed areas such as the hinges.

Other variations on the device could be made without departing from the scope of the invention as claimed. For example, in one embodiment padding could be added to the base 11 and support 15 to increase the overall comfort of the device 10. In yet another embodiment of the device 10, the base 11 could be formed of a square frame instead of the solid rectangular piece that is shown in FIG. 2. The individual sections of this square framed base could be constructed of round or square tubing or be flat pieces of material that fit easily between the person 30 and the bench 20.

The above description sets forth embodiments that the inventors discovered provide a preferred configuration and mode for practicing the claimed invention. Unless specified otherwise, however, neither the description of the device, nor method of using it, is intended to limit the scope of the properly construed claims. Thus, neither the materials of the device nor their configuration as disclosed in the illustrative embodiments limit the claims unless specifically stated otherwise. Accordingly, modifications and substitutions by one of ordinary skill in the art are considered to be within the scope of the present invention, which is not to be limited except by the following claims.

What is claimed is:

1. A portable safety device for use with a bench press weight lifting bench comprising:

a) a base plate configured to be placed between a weight lifter and said bench press weight lifting bench such that a bottom of said base plate contacts a top surface of said bench press weight lifting bench and a top of said base plate contacts a back of said weight lifter;

b) first and second hinges attached to said base plate;

c) first and second vertical support members attached to said first and second hinges, respectively, and extending vertically away from said base plate; and d) a protective portion, attached to said first and second vertical support members, said protective portion comprising horizontal supports disposed parallel to said base plate, said protective portion comprising vertically descending portions descending downward from ends of said horizontal supports toward said base plate and extending inward and attaching to a support plate, said protective portion configured so that said support plate rests on said weight lifter's chest and sternum when said base plate is in contact with said back of said weight lifter, thereby providing protection to said weight lifter's head, face and neck.

2. The portable safety device of claim 1 wherein said base plate includes a means for securing said base plate to said bench press weight lifting bench.

3. A portable weight lifting safety device comprising:

a) a generally rectangular base;

b) first and second hinges attached to said generally rectangular base;

c) first and second vertical support members attached to said first and second hinges and extending vertically away from said generally rectangular base;

d) a protective portion, attached to said first and second vertical support members, and disposed parallel to said generally rectangular base, wherein said protective portion comprises a first horizontal member extending from said first vertical support member and a second horizontal member extending from said second vertical support member, and vertically descending portions descending downward from each horizontal member and extending inward to a support plate, said protective portion configured so that said support plate rests on a weight lifter's chest and sternum when said generally rectangular base is in contact with a back of said weight lifter, thereby providing protection to said weight lifter's head, face and neck; and e) a means for securing said generally rectangular base to a bench press weight lifting bench.

4. A portable safety device for use with a bench press weight lifting bench comprising:

a) a base configured to be placed between a weight lifter and said bench press weight lifting bench such that a bottom of said base contacts a top surface of said bench press weight lifting bench and a top of said base contacts a back of said weight lifter;

b) first and second hinges attached to said base;

c) first and second vertical support members attached to said first and second hinges, respectively, and extending vertically away from said base; and d) a protective portion, attached to said first and second vertical support members, and disposed parallel to said base, said protective portion providing protection to said weight lifter's head;

e) wherein said protective portion comprises a first horizontal member extending from said first vertical support member and a second horizontal member extending from said second vertical support member, and vertically descending portions descending downward from each horizontal member and extending inward to a support plate, said protective portion configured so that said support plate rests on said weight lifter's chest and sternum when said base is in contact with said back of said weight lifter, thereby providing protection to said weight lifter's head, face and neck.

* * * * *